US007536802B1

(12) United States Patent
Tavy et al.

(10) Patent No.: US 7,536,802 B1
(45) Date of Patent: May 26, 2009

(54) LOW-OBSCURING TILE INSTALLATION SPACER

(75) Inventors: Armen Tavy, Plant City, FL (US); Keith Tavshanjian, Oceanside, CA (US)

(73) Assignee: Tavy Enterprises, LLC, South Windsor, CT (US)

( * ) Notice: Subject to any disclaimer, the term of this patent is extended or adjusted under 35 U.S.C. 154(b) by 0 days.

(21) Appl. No.: 11/942,136

(22) Filed: Nov. 19, 2007

(51) Int. Cl.
*G01B 3/30* (2006.01)
*G01D 21/00* (2006.01)

(52) U.S. Cl. ..... 33/527

(58) Field of Classification Search ..... 33/527, 33/526

See application file for complete search history.

(56) References Cited

U.S. PATENT DOCUMENTS

| | | | | |
|---|---|---|---|---|
| 3,010,213 | A * | 11/1961 | Rodtz, Sr. | 33/526 |
| 4,955,142 | A | 9/1990 | Rieck | |
| 5,288,534 | A | 2/1994 | Tavshanjian | |
| 5,623,799 | A | 4/1997 | Kowalski et al. | |
| D492,210 | S | 6/2004 | Shilo et al. | |
| 6,769,191 | B1 * | 8/2004 | Zusman | 33/526 |
| 6,874,242 | B2 | 4/2005 | Shilo et al. | |
| 2004/0250435 | A1 * | 12/2004 | Fiore | 33/527 |

FOREIGN PATENT DOCUMENTS

| | | | |
|---|---|---|---|
| EP | 0669424 | B1 | 8/1995 |
| JP | 09-004205 | A | 1/1997 |
| JP | 2001-040869 | A | 2/2001 |
| WO | PCT/US2008/079345 | A | 10/2008 |

* cited by examiner

*Primary Examiner*—Christopher W Fulton
(74) *Attorney, Agent, or Firm*—Duane Morris, LLP

(57) ABSTRACT

The disclosure relates to tile-spacing devices for spacing tiles apart from one another during their installation, so as to create a space between the tiles, such as a space into which a grout, mortar, sealant, or other material can be inserted. Like previous tile-spacing devices, the devices described herein include one or more spacers disposed on a base. However, unlike previous devices, the devices described herein have a window that extends through the base, through which engagement of at least one of the tiles with the edge of a spacer can be visually observed.

20 Claims, 3 Drawing Sheets

LOW-OBSCURING TILE INSTALLATION SPACER

BACKGROUND

The disclosure relates generally to the field of tile installation. Commonly installed tiles include those made of ceramic, stone, wood, webbed mosaic, and other materials. Tile installation spacers are widely used by both professionals and novices for maintaining adequate and consistent spacing between tiles.

In the process of covering floor, wall and counter surfaces with ceramic tile and the like, individual tiles, or sheets of mosaic glued to a mesh webbing, are individually set into either some form of adhesive, or some form of mortar. In the process of setting the individual pieces, it is known to use tile spacers to assist in achieving uniformly sized grout spacing between the tiles or sheets of mosaic. These are typically in the shape of a cross, so as to define a corner where four tiles will intersect. One leg of the cross can be cut off, making a T spacer, which can be used when an offset layout is utilized, with T-shaped grout spaces at the intersection of three tiles. The spacers are typically made of semi-rigid plastic or soft rubber having depths ranging from ⅛ to ¼ of an inch, with spacing widths of between 1/32 of an inch (i.e., <1 millimeter) and ⅜ of an inch or more. For brick, cement block and larger tiles, larger sizes of spacers, with considerably more depth, are used.

The spacers are sometimes used edgewise as an aid to laying out an array of tiles where a long row of dry tiles can be laid out, set apart by the edgewise spacers. Layout can be adjusted or changed prior to fixation of the tiles, because installers can better determine the best lay of the tiles using spacers prior to fixing tiles. Tape measures or other devices are difficult to use and precise tile location marks are often less than accurate. The profile of the invention prevents the device from toppling over or turning sideways or falling into the proposed grout joint and sometimes slipping under the tiles. Such spacers also are sometimes used edgewise as stacking spacers for vertical installations (wall tiles).

Most tile layers have large, heavily callused fingers and find the spacers hard to handle. The spacers must be removed from the grooves between the tiles after the tiles are set, by means of a pick, thin spatula, or other spacer remover tools. When working with the spacers, it is difficult to handle them and move them around. Additionally, they provide no guide to the depth of the lay of the tiles (the uniformity of the final finish across several tiles) as the job proceeds.

Improved tile spacing devices are disclosed in U.S. Pat. No. 5,288,534. This patent discloses spacers having straight, cross-shaped, or T-shaped raised spacer elements on one or both sides of a generally disk-shaped platform. The spacer on one side of the platform can be used as a handle for inserting and removing the spacer on the other side of the platform. Also, the entire device is larger and more easily handled than the traditional flat, cross-shaped spacer (with or without an extended handle). The platform rests against the outer surfaces of the adjacent tiles, providing a guide for maintaining a uniform height and even level across multiple tiles. The tile spacers disclosed in that patent have enjoyed significant commercial success.

A criticism leveled by some, particularly non-professional, tile setters is that portions of known tile spacers can obscure their ability to visually confirm that they have correctly aligned edges and corners of tiles using the spacers. A need exists for a tile spacing device that is easily handled, inserted, and removed, has a profile suitable for direct visual confirmation of tile arrangement, provides a guide for laying tiles uniformly across several tiles, and allows the user to view the engagement of the spacer with the tiles and the alignment of the tiles. The technology described herein satisfies this need.

BRIEF SUMMARY OF THE DISCLOSURE

The disclosure pertains to a device for spacing tiles on a surface having a selected conformation. The device has a base with a first surface. The first surface of the device has substantially the same contour as the surface receiving tiles. A first spacer is disposed on and extends from the first surface away from the base. The base defines a window extending therethrough from the first surface. When the first spacer is engaged with tiles on the surface, the spacing of the tiles or the engagement of a tile with the first spacer can be seen by a user through the window.

In one embodiment, the base also has a second surface with substantially the same contour as the selected conformation. The second surface has a second spacer for engaging tiles disposed on and extending from the second surface away from the base. When the second spacer is engaged with tiles on the surface, the spacing of the tiles or the engagement of a tile with the second spacer can be seen by a user through the window.

In another embodiment, the window extends through the first spacer. In yet another embodiment, the window extends through both the first and second spacers. In a preferred embodiment, the device is disk-shaped, has a hollowed-out window and the base and the spacers are monolithic.

The disclosure also relates to a device for spacing tiles on a surface of a selected conformation having a base with a first surface and a second surface. The first and second surfaces have substantially the same contour as the selected conformation. The device has a first spacer disposed on and extending from the first surface away from the base for engaging tiles. The device also has a second spacer disposed on and extending from the second surface away from the base for engaging tiles. The base has a window extending therethrough from the first surface to the second surface. The window is disposed on the base so as to permit viewing therethrough of a tile engaged by one of the spacers.

DETAILED DESCRIPTION

Figure 1:
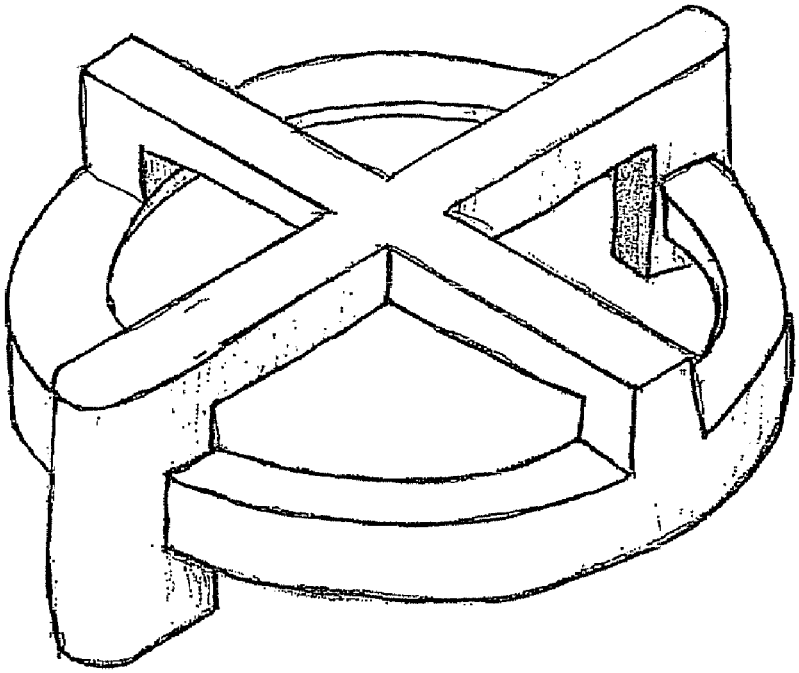
FIG. 1 is a perspective top view of a tile spacer described herein.

The present disclosure relates to a device for spacing tiles. The device disclosed herein comprises a first tile spacer and a second tile spacer disposed on opposite sides of a platform. The platform has a window extending through the platform (and optionally through one or both of the spacers), which allows a user to view the engagement of one or more tiles by a spacer of the device. The device overcomes a shortcoming of previous devices, whereby users had difficulty observing alignment of tiles with one another or with the spacer on account of obstruction caused by the spacer body.

DEFINITIONS

As used herein, each of the following terms has the meaning associated with it in this section.

A "spacer" is a device, or an element of a device, which has a physical bulk, size, and shape suitable for maintaining a space between objects opposed against different parts of the spacer. By way of example, a raised bar-shaped portion of a device can be inserted between two tiles and the tiles can be urged against that portion in order to space the tiles apart from one another by the width of the bar-shaped portion. In that example, the bar-shaped portion of the device is a spacer. Similarly, a cross-shaped spacer element (i.e., two intersecting bar-shaped spacer elements) can define a selected separation distance between four tiles.

A "window" is a void in or a transparent section of an object that extends from one side or face of the object, such that light can travel from one side of the object to the opposite side through the void or section.

DETAILED DESCRIPTION

The disclosure relates to tile-spacing devices for spacing tiles apart from one another during their installation, so as to create a space between the tiles, such as a space into which a grout, sealant, or other material can be inserted. Like previous tile-spacing devices, the devices described herein include one or more spacers disposed on a base. However, unlike previous devices, the devices described herein have a window that extends through the base, through which engagement of at least one of the tiles with the edge of a spacer can be visually observed. The components of the devices described herein are separately described in greater detail below.

The Base

The devices described herein have a base portion that bears one or more spacer elements. In use, the base typically remains on the outside of (i.e., not in the space between tiles) the surface to be tiled. The base serves as body that can be held or gripped by a user (e.g., a portion that can be gripped during extraction of the device following tile installation). The base also connects spacer elements in devices that bear multiple spacer elements and prevents the device from being inserted entirely into the space between the tiles during installation of the tiles.

The size and shape of the base are not critical, but should generally be sized and shaped to render their use convenient in tile setting operations. For example, the thickness of the base can be 1/16 of an inch. The size of the devices should be sufficiently large that the devices can be manipulated by workers who may have gloved or heavily calloused hands. The overall size of the devices should also be sufficiently small that a plurality of the devices can be used to space the tiles on a surface without the devices placed in adjacent tile joints interfering with the operation of one another. For example, generally disc-shaped devices having an outside diameter of about 1 1/8 inches are convenient, and still larger devices remain convenient. The shape of the base should extend beyond the spacer in at least one direction, so that the device does not fit entirely within a tile joint in its normal operation. The outermost portion of the base can extend to the outermost dimension of a spacer or beyond. Alternatively, the outermost dimension of the spacer can extend beyond the outermost portion of the base. The base can be shaped and dimensioned to permit most of the area of the base to define a window extending therethrough. Preferably, the base has a width (parallel to the face of the tiles being spaced when the device is set between two tiles) that has sufficient rigidity to prevent easy deformation or shifting of the spacer in the course of normal manipulation of tiles, such as a minimum width of about 1/16 of an inch for devices having a base made from low density polyethylene.

The base bears a spacer element extending outwardly from at least one portion of the base. The shape of the portion from which the spacer extends should have a shape that generally follows the contour of the desired final shape of the surface to be formed by the tiles spaced using the device. Thus, for tiles that are intended to form a substantially flat surface following their installation, the tile spacing device should have at least one substantially flat (i.e., generally planar) surface from which a spacer element extends. Similarly, if the finished tile surface is to be curved, the portion of the device from which the spacer extends should have a curvature that substantially matches the contour of the exterior face of the desired curved, tiled surface.

The base can have two or more spacer elements extending therefrom. Multiple spacer elements can extend from a single surface (e.g., a single flat face) of the base. Thus, for example, a surface of the base can bear two 'L'-shaped spacer elements, intended to engage opposite corners on the bottom edge of a vertically-mounted square tile and to space that tile a defined distance from tiles mounted one either side of the tile and a defined distance from tiles mounted below the tile. Spacer elements can also extend from different surfaces of the base. In one embodiment, the base is generally disc-shaped (as in U.S. Pat. No. 5,288,543), being essentially a short right cylinder, and has one spacer element extending from each of the two parallel round faces. The base can have other shapes as well, such as a generally pyramidal or cubic shape, with one or more faces of the base each bearing a spacer element.

The base preferably has a generally flattened profile and bears two spacer elements, with each flattened face of the base bearing one of the spacers. As shown in U.S. Pat. No. 5,288,543, the spacers on the opposite faces of the base can have different shapes, thereby making the device useable for different tile-spacing tasks.

The Spacer Element

The device has at least one spacer extending from a surface of the base. The spacer can be an extension of a unitary piece of material used to form both the base and the spacer. Alternatively, the spacer and the base can be formed of separate pieces of (the same or different) material and attached in a conformation whereby the spacer extends away from, and preferably substantially perpendicularly away from, the base.

The spacer should extend from a portion of the base that (ignoring the spacer element) has a shape that generally conforms to the exterior shape of the finished tile surface. In this conformation, the spacer can be inserted into a space between tiles and the portion of the base to which the spacer is attached can engage the exterior portion of one or more of the tiles. It is not necessary that the base engage one or more tiles when the spacer is inserted between tiles. Nonetheless, engagement of the tiles with a similarly-shaped portion of the base can serve to confirm correct placement of the tiles. By way of example, a base having a cross-shaped spacer extending from a substantially flat portion of the base can be used to separate four tiles having ninety-degree corners that meet at a cross-shaped junction by inserting the spacer among the corners of four tiles; if the flat portion of the base engages all four tiles, then that is an indication that all four of the tiles have a substantially co-planar surface, at least in the vicinity of the junction.

In the devices described herein, the base has at least one spacer extending therefrom and situated such that a user can look through a window that extends through the base and confirm engagement between a tile and the spacer. Because the devices described herein are intended to space multiple (i.e., two or more) tiles, the spacer should preferably be situated on the base such that at least two (and preferably all) surfaces of the spacer element that are intended to engage tiles can be viewed through one or more windows in the base. In this way, a user can visually confirm alignment of corners and edges at multiple sites of engagement between tiles.

In operation, the spacer of the device is interposed between adjacent tiles and the tiles are urged against different portions of the spacer. The distance between the different portions of the spacer therefore define the distance between tiles installed using the devices. Ordinarily, the portions of the spacers against which the tiles are urged are generally parallel, at least when tiles having flat edges (viewed from above the tiled surface) and flat sides (i.e., the sides of the tiles being spaced form a substantially right angle with the exterior surface of the tile) are being spaced. In this situation, the portion of the spacer that extends away from the base will have two planar surfaces that are generally parallel along the lengths engaged by the spaced tiles.

The distance that the spacer extends away from the base is not critical. This distance represents the length of the portion that will extend into the gap between tiles being spaced (i.e., the maximum "depth" to which the spacer element can be inserted). The spacers preferably extend away from the base a distance that is at least a significant fraction of the height of the tiles between which the spacer is to be inserted, such as three quarters of the depth, half the depth, or one quarter of the depth. Spacers extending shorter distances are not inoperable, but can be impractical to use under conditions normally incident to tile installation, in which speed and correct tile spacing are beneficial. The distance the spacer extends away from the base should take into account the thickness of the tiles between which the spacer will be inserted (i.e., the depth of the channel between adjacent tiles) and the depth of any material (e.g., mortar, grout or another adhesive) that is anticipated to be present or inserted into the space between the tiles. In a common example, tiles are set into a bed of mortar during use of the tile spacing devices described herein. The spacer should be formed such that it does not extend so far between tiles that the spacer is embedded into mortar in which the tiles are set, and preferably does not even contact a typical mortar surface, which tends to prevent mortar from being 'squeezed out' from between the tiles and staining an edge or face of a tile. Such stains are a nuisance and can be difficult to remove or reduce prior to grouting, and even more difficult after grouting. Examples of the distance that the spacer can extend away from the base include one-eighth of an inch, three-sixteenths of an inch, and one-quarter of an inch. For thicker tiles (e.g., glass blocks having a thickness of four inches), a greater spacer length is practical, such as one-half inch or one inch. The distance is not critical, and is conveniently a significant fraction (e.g., 40%-60%) of the total height of the device, such that a substantial portion of the device remains above the tile during use.

The distance between tiles spaced with the devices described herein is dependent on the width of the spacer elements (which define the tile-to-tile distance of tiles urged against the spacer). Most frequently, tile spacing devices are used to define a constant inter-tile distance between tiles having flat edges. The spacers that yield such spacing have a thickness that is uniform along the lateral (in the direction parallel to the tile joint) length of the spacer. The uniform thickness must occur at least along the portion of the spacer that engages adjacent tiles, but can be different at portions that do not engage the tile, such as at the distal (with respect to the base) tip of the spacer element, which can have a square, rounded, beveled, or otherwise-shaped profile. A rounded or beveled tip at the distal end of the spacer element can also guide insertion of the spacer between adjacent tiles. Common inter-tile grout space widths include one-sixteenth, one-eight, one-quarter, and three-eights of an inch, but substantially any width can be generated by controlling the thickness of the spacer.

It can be difficult to distinguish tile-spacing devices that have spacer elements having similar spacer thickness values (i.e., a one-quarter inch spacer looks very much like a three-sixteenths inch spacer under the conditions normally incident to tile installation). For that reason, it can be beneficial to include on or in the tile-spacing device an indicium of the spacer thickness. Such indicia can include a written designation of the spacer thickness written on, engraved on, or molded into the body. Other examples of such indicia include the color of the material from which the device is constructed or the shape of the body or some portion thereof. Substantially any means for visually distinguishing devices having different spacer thicknesses can be used.

The spacers can be configured to separate two, three, four, or more tiles. The configuration is selected by including at least as many tile-impinging portions on the spacer as there are tiles to be spaced. Thus, a spacer intended to separate two tiles having straight edges may have only two tile-impinging portions (e.g., the sides of a spacer having a rectangular profile in the plane normal to the surface of the base from which the spacer extends), such as a bar-shaped spacer. In such a setup, the straight edge of one of the two tiles engages one of the two parallel faces of the spacer, and the straight edge of the other of the tiles engages the opposite face of the spacer, resulting in a parallel configuration of the straight edges of the tiles. Cross-shaped spacers (i.e., two intersecting straight spacer elements) can similarly engage four tiles, each of which tiles has a corner formed of two flat portions intersecting at a ninety-degree angle. Spacer configurations for engaging other numbers of straight-edge tiles and configurations for engaging curved tiles are immediately apparent to a skilled artisan in this field.

The spacer element may engage a single tile along a single, continuous portion or at multiple sites. By way of example, a bar-shaped spacer element and a spacer element that engages a tile only at the two sites corresponding to the ends of the bar can engage a straight-edged tile in an identical position. That is, tile-spacing devices having these two alternative spacer configurations can interact in substantially the same way with a tile having a straight edge engaged with the spacers. Thus, the devices described herein can include multiple spacer elements for engaging substantially any practical number of tiles in substantially any configuration, and the relative placement of spacer elements on such a device will be immediately apparent to a skilled artisan in this field once the desired configuration of the installed tile is defined. Indeed, a skilled artisan can design numerous spacer configurations that can yield the same finished tile configuration, and the devices disclosed herein are not limited to any particular configuration of spacers. Straight spacers, corner spacers (i.e., spacers having two straight elements that meet at a defined angle and extend in only one direction away from the intersection), cross-shaped spacers, and T-, Y-, L-, V-, and star-shaped spacers are all envisioned, as are others that are apparent to the skilled artisan.

The spacer element preferably has an edge that engages a similarly-shaped edge of a tile. For example, a spacer having a straight edge can engage a tile having a straight edge. Similarly, although a pair of posts having a round cross-section can also engage a straight edge (i.e., at two points), it is preferable that one or both of the posts have a substantially flat edge for engaging the tile edge at more than one point, so as to inhibit shifting or 'rolling' of the spacer device when oblique forces are applied to the engaged tile.

The Window

In the devices described herein, a window extends through the base at a location that allows a user to see engagement between at least one spacer and at least one tile when the device is applied against a tile. The window allows the user to view the relative positions of the spacer and tiles through the base and visually verify that the tile is properly seated against the spacer. The device can include multiple windows, so that engagement of tile(s) and spacer(s) can be viewed at a plurality of locations. A single window can have dimensions sufficiently large and can be placed so as to permit the user to view engagement of multiple tiles with different portions of a single spacer, multiple spacers with a single tile, multiple tile-spacer engagement points, or some combination of these. The arrangement, shape, and size of the window are not critical, so long as the user is enabled to view through the window engagement of at least one tile with at least one spacer.

The shape and conformation of the window is not critical. A single large window can be formed in the base, whereby engagement of each of two tiles with opposite sides of a single straight spacer can be viewed, for example. Further by way of example, a device having a cross-shaped spacer extending therefrom can have a window situated such that engagement of each of four tiles with various portions of the spacer can be viewed and alignment of the corners of the four tiles can be viewed as well.

In one embodiment, the base is substantially disk-shaped, having a generally circular cross-section and a spacer extending from at least one of the two flat sides. A substantially circular window extends through the base (and optionally through one or both spacers, if two are present). The device, in this embodiment, has the appearance of a circular 'ring' with a spacer on one or both flat faces of the ring. If the window extends through the spacer(s), then the width of the spacer can be limited to substantially only the space above the ring. Alternatively, a portion of the spacer can extend into the ring (looking perpendicular to the plane of the ring), outside of the ring, or both. Rather than being 'ring'-shaped, similar tile spacing devices can have a 'hollow square,' 'hollow triangle', or other polygonal-outline shaped flat portion having one or two spacer elements extending outwardly from a flat surface of the circular or polygonal ring. In each of these embodiments, the rigidity of the ring tends to hold the spacers in a fixed alignment, preventing shifting or movement of the spacer elements upon imposition of various forces to the tiles engaged by the device during installation.

The window should be situated such that the planarity of 'top' surfaces of tiles engaged by the spacer (i.e., the surfaces of the tiles opposite the surface fixed to the substrate) can be visually assessed. Preferably, at least a portion of any spacer element between the tiles that is visible through the window is entirely below the top surfaces of the tiles. This permits direct visual comparison of the top surfaces of the tiles, whereas presence of an intervening spacer above and between the top surfaces along the entire length of the joint visible through the window can obstruct such assessment. Put another way, it is preferable, for any spacer element that is visible in the window, that either i) there be a gap in the spacer element, through which gap alignment of the top surfaces of the tiles can be assessed or ii) a portion of the spacer element visible through the window is recessed away from the base and window sufficiently that the proximal surface of the spacer at that portion is beneath the top surfaces of the tiles visible in the window.

Materials and Construction

The devices described herein can be made from separate parts which are adhered or otherwise fastened together from separately-manufactured parts. Preferably (for economic reasons, for example), the devices can be unitary, and can be made by molding, pressing, machining, or otherwise shaping a single piece of material.

The identity of the material(s) from which the devices are constructed is not critical. The material should be selected for compatibility with tiles and humans. The material should preferably be selected for ruggedness, so that the devices constructed therefrom can be used multiple times under conditions normally incident to tiling operations. These criteria indicate, of course, that the devices described herein can be made from any of a wide variety of materials, including plastics, metals, woods, ceramics, glasses, waxes, ice, and other materials. Plastics are preferred for reasons of economy and ease of manufacture. Suitable plastics include polyethylenes (e.g., high-density or low-density polyethylene), acrylics, polycarbonates, various thermoplastic materials, and natural and artificial rubbers.

The material must be sufficiently rigid that the device will not melt, bend easily, compress easily, or otherwise deform under the stresses normally incident to tile installation operations. Semi-rigid, or even rubbery, devices can be used, and the non-brittleness of such materials can beneficially affect their durability. The material is preferably selected such that it can be cut using tools (e.g., pocket knives, scissors, snips, etc.) available to a tile setter. Such a choice of materials permits customization of the device described herein for use in particular tile setting situations peculiar to many tile setting jobs (e.g., setting of tiles around an obstruction in an otherwise-flat surface). The material is also preferably a material having a specific density less than that of water, so that the devices described herein will float on water (e.g., in a bucket of water used by a tile setter). Devices that float in water can also be conveniently cleaned (e.g., by agitating water in which the devices are floating).

In one embodiment, the devices are made simply by molding. By way of example, a two-piece mold having a void in the shape of the finished device (and optionally having one or more projections extending into or through the void) is assembled, and the assembled mold is flooded with a polymer resin. Upon total or partial solidification of the resin, the mold is disassembled and the molded device is removed therefrom. The window that extends through the base of the device can be formed during the molding process. For example, a projection from the mold can extend through the portion of the mold's void that corresponds to the base, such that when the mold is filled, the projection excludes the material from the portion of the base corresponding to the window. The projection should be situated within the void such that the window is formed immediately adjacent to or overlapping a portion of the void corresponding to at least one of the spacers, so that engagement of a tile with the spacer can be viewed through the window when the so-manufactured device is used.

Alternatively, the window can be formed after a device lacking the window is formed. By way of example, a base having one or more spacers extending therefrom can be made, the base lacking the window described herein. After manufacture of this object, a hole can be bored through the base in a location such that engagement of a tile with at least one of the spacers can be viewed while the device is being used.

Use of the Device

The devices described herein are used by interposing their spacer portion(s) between tiles that are being arranged in a desired pattern. Such arrangement is considered critical to the appearance of many tiled surfaces, such as tiled walls and floors. By way of example, it is frequently considered desirable to arrange square tiles in rows and columns, such that the flat edges of the tiles and grout installed between the tiles forms straight lines that intersect at right angles at regular intervals (i.e., a "square grid" pattern).

The devices described herein can be used to transition a tile arrangement pattern from a floor to a wall. In such an arrangement, a spacer of the device is inserted between tiles of one of the floor and wall, and a spacer (the same spacer or a different one) of the device extends into the space between tiles of the other of the floor and the wall, thereby aligning the tile joint of the floor with the tile joint of the wall.

Figure 4:
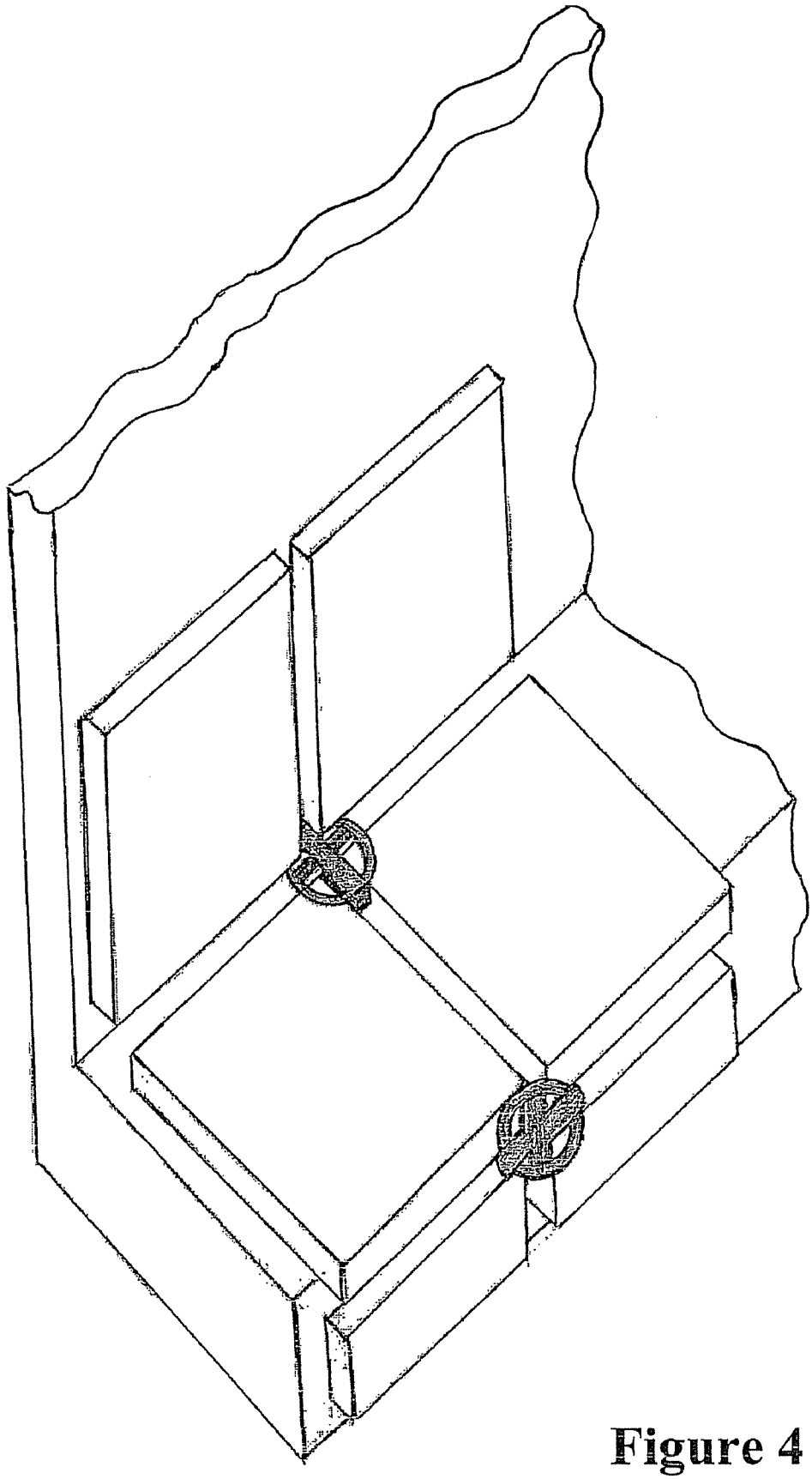
FIG. 4 is a perspective view of a pair of tile spacers used to align six tiles, two of which tiles are horizontally situated, two of which rise vertically from a back edge of the horizontal tiles, and two of which rise vertically to meet the front edge of the horizontal tiles.

As shown in FIG. 4, the tile spacing devices disclosed herein can serve a variety of functions at the intersections of planar or contoured surfaces. For example, in FIG. 4, a pair of tiles are laid horizontally on a horizontal surface. The two horizontal tiles are separated by two tile spacing devices, each having a 'leg' of a cross-shaped spacer interposed at least partially between the two tiles. A horizontal joint of substantially constant width is thereby created between the two horizontal tiles. A pair of tiles is arranged vertically against a surface rising at an edge of the two horizontal tiles. The platform portion of the tile spacing device inserted between the two horizontal tiles at this edge rests atop the two horizontal tiles and a straight spacer extends from the platform in the direction away from the horizontal tiles (in this diagram, the straight spacer could as well be cross-shaped). The bottom edge of each of the two vertically-oriented tiles rest on the face of the platform opposite the face resting upon the horizontal tiles, thereby spacing the vertical tiles above the top of the horizontal spacers by a constant distance equal to the thickness of the platform. (In operation, additional spacers would support the bottom corners of the vertical tiles, but those spacers are not shown in FIG. 4 for the sake of clarity.) The spacer element that extends away from the horizontal tiles is interposed between the two vertical tiles, thereby imposing a controlled separation distance between the two vertical tiles.

FIG. 4 also shows the operation of the tile spacing device in a second orientation. Extending vertically downward from the 'front' edge of the horizontal tiles are a pair of vertical tiles. A tile spacer device having a cross-shaped spacer on one substantially flat face of a platform has one 'leg' of the spacer interposed between the horizontal tiles. The two orthogonal legs of the spacer engage the bottom edge of the horizontal spacer, and those legs also engage the top edge of the vertical tiles, thereby imposing a controlled separation distance between the top edges of the vertical tiles and the bottom edge of the horizontal tiles. The remaining leg of the spacer is interposed between the two vertical tiles, thereby imposing a controlled separation distance between the two vertical tiles. The substantially flat surface of the platform ensures that the flat faces of the vertical tiles are substantially co-planar with the side edges of the horizontal tiles.

The devices are typically applied to tiles, the spacer portions of the devices extending between the tiles, while the tiles are being installed or fixed to a surface. Typically, an adhesive (e.g., a glue or mortar) is applied in a thin coat to the surface, and the tile is pressed onto the adhesive. Prior to setting or hardening of the adhesive, the tiles can be moved or shifted laterally across the surface. The devices described herein can be applied to the tiles at different times during this process, but are usefully applied only prior to setting or hardening of the adhesive (i.e., so that the tiles can be shifted and the spacer portions of the devices can be used to guide the configuration and arrangement of the tiles prior to such setting or hardening).

In one embodiment, a device described herein is applied to a tile that has already been set in place. The device is held (e.g., manually) so that at least a portion of a spacer element engages an edge of the tile, the spacer extending away from the base and in the direction of the adhesive or mortar.

EXAMPLE

The subject matter of this disclosure is now described with reference to the following Example. This Example is provided for the purpose of illustration only, and the disclosure is not limited to this Example, but rather encompasses all variations which are evident as a result of the teaching provided herein.

Figure 2:
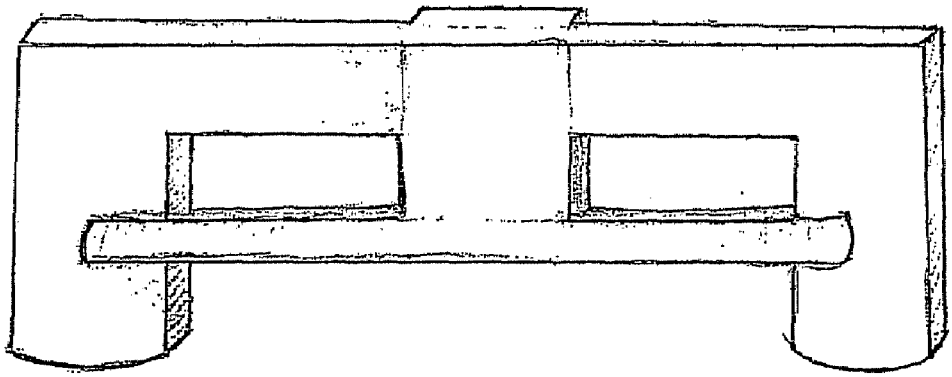
FIG. 2 is a perspective side view of a tile spacer depicted in FIG. 1.
Figure 3:
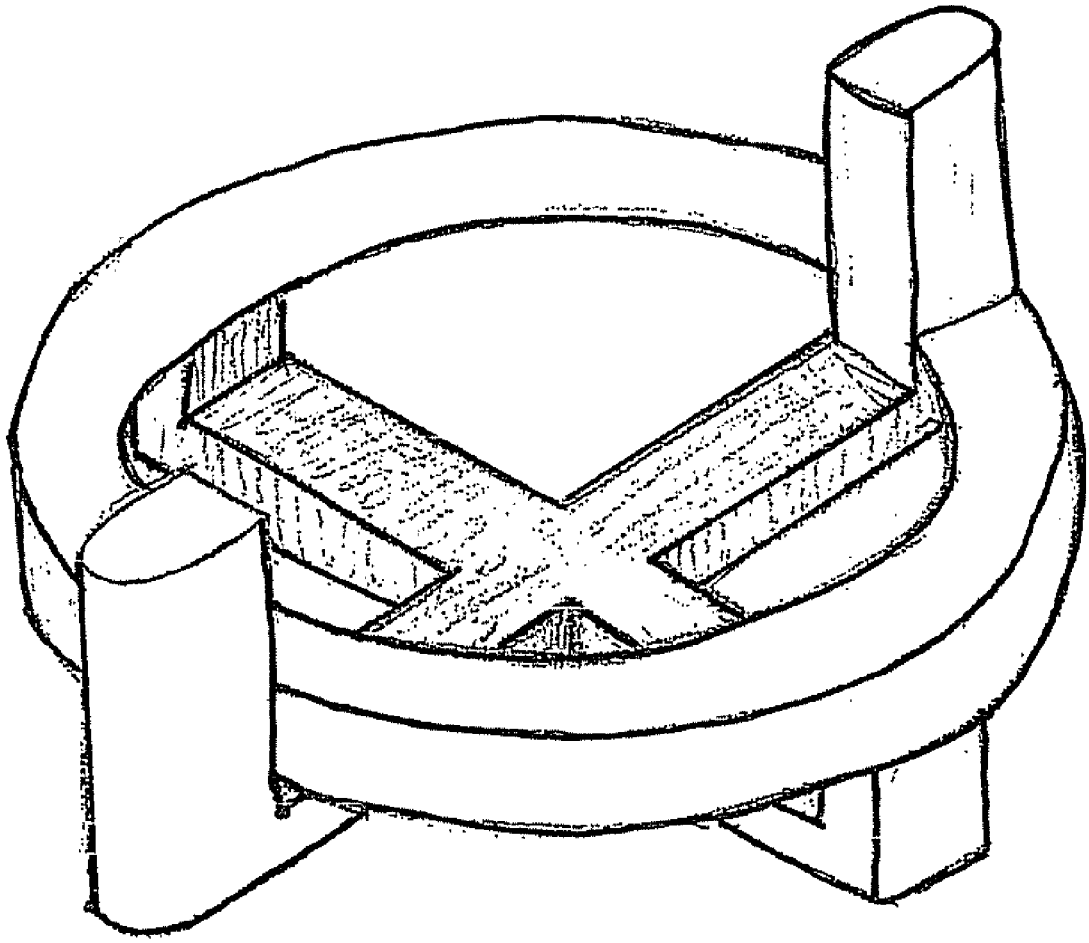
FIG. 3 is a perspective bottom view of the tile spacer device depicted in FIG. 1.

One example of a device described herein is illustrated in FIGS. 1, 2, and 3. In this embodiment, the base is disk-shaped and has a large concentric circular window, which is a substantially concentric void in the central portion of the base. The device has a straight spacer affixed to one face of the base, and a cross-shaped (corner) spacer is affixed to the opposite face. The window extends through the straight spacer leaving two block-like structures, each having a rounded outer edge extending across the remaining surface of the base. The corner spacer bridges the window in a plane parallel to but not coplanar with the base. The base and spacers are monolithic, and the device is formed of a single piece of semi-rigid thermoplastic. In operation, either the straight spacer or the corner spacer is inserted into a void between tiles. The tiles can be urged against the corresponding portions of the spacers, and correct alignment of the tiles and engagement of the tiles with the spacers can be confirmed by viewing these items through the spacer device by way of the window.

The disclosure of every patent, patent application, and publication cited herein is hereby incorporated herein by reference in its entirety.

While this disclosure has been made with reference to specific embodiments, it is apparent that other embodiments and variations of this subject matter can be devised by others skilled in the art without departing from the true spirit and scope of what is disclosed herein. The appended claims include all such embodiments and equivalent variations.

What is claimed is:

1. A device for spacing tiles on a surface having a selected conformation, the device comprising a base having a first surface having substantially the same contour as the selected conformation and a first spacer disposed on and extending from the first surface away from the base for engaging tiles, the base defining a window extending therethrough from the first surface, the first spacer bridging the window, whereby when the first spacer is engaged with tiles on the surface, engagement of a tile with the first spacer can be seen by a user through the window.

2. The device of claim 1, wherein the window extends through the first spacer.

3. The device of claim 1, wherein the base also has a second surface having substantially the same contour as the selected conformation and having a second spacer for engaging tiles disposed on and extending from the second surface away from the base, whereby when the second spacer is engaged with tiles on the surface, at least one of the spacing of the tiles and engagement of a tile with the second spacer can be seen by a user through the window.

4. The device of claim 3, wherein the window extends through both the first and second spacers.

5. The device of claim 3, wherein the first spacer is straight and the second spacer is cross-shaped.

6. The device of claim 3, wherein one of the first and second spacers bridges the window and wherein a section of the spacer that bridges the window is transparent.

7. The device of claim 3, wherein both of the first and second spacers bridge the window and wherein a section that bridges the window of each of the first and second spacers is transparent.

8. The device of claim 1, wherein the first spacer is cross-shaped.

9. The device of claim 1, wherein the first spacer is T-shaped.

10. The device of claim 1, wherein the first spacer is straight.

11. The device of claim 1, wherein the device is disk-shaped.

12. The device of claim 1, wherein the base and the first spacer are monolithic.

13. The device of claim 12, wherein the device is made from a molded thermoplastic material.

14. The device of claim 1, further comprising an indicator of the width of a spacer.

15. The device of claim 14, wherein the indicator is a coloring.

16. The device of claim 1, wherein a transparent material fills a portion of the window.

17. The device of claim 16, wherein the transparent material fills substantially all of the window.

18. The device of claim 1, wherein a section of the first spacer that bridges the window is transparent.

19. The device of claim 1, wherein the edge of the first spacer proximal to the base is recessed away from the base at a portion of the first spacer that bridges the window, whereby when the device is engaged with tiles on the surface, the edge of the first spacer is beneath the face of the tiles that is engaged by the first surface.

20. A device for spacing tiles on a surface having a selected conformation, the device comprising a base having a first surface having substantially the same contour as the selected conformation and a second surface having substantially the same contour as the selected conformation a first spacer disposed on and extending from the first surface away from the base for engaging tiles; and a second spacer disposed on and extending from the second surface away from the base for engaging tiles;

wherein the base has a window extending therethrough from the first surface to the second surface, with at least one of the first and second spacers bridging the window, disposed on the base so as to permit viewing therethrough of a tile engaged by one of the first and second spacers.

* * * * *